US006358102B1

(12) United States Patent
Fukamachi

(10) Patent No.: US 6,358,102 B1
(45) Date of Patent: Mar. 19, 2002

(54) CONNECTOR WITH RETAINER MOVING GUIDE

(75) Inventor: Makoto Fukamachi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/734,182

(22) Filed: Dec. 12, 2000

(30) Foreign Application Priority Data

Dec. 13, 1999 (JP) ..... 11-353033

(51) Int. Cl.[7] ..... H01R 13/514
(52) U.S. Cl. ..... 439/752
(58) Field of Search ..... 439/271, 725, 439/595

(56) References Cited

U.S. PATENT DOCUMENTS 5,167,534 A * 12/1992 Ohsumi ..... 439/595
5,618,207 A * 4/1997 Maejima ..... 439/595
5,797,772 A * 8/1998 Sakurai et al. ..... 439/752
5,830,013 A * 11/1998 Saito et al. ..... 439/595
5,890,935 A * 4/1999 Pill ..... 439/752
6,036,553 A * 3/2000 Seko et al. ..... 439/752
6,139,375 A * 10/2000 Konoya et al. ..... 439/752
6,155,888 A * 12/2000 Kurimoto ..... 439/752

FOREIGN PATENT DOCUMENTS

EP 903 814 3/1999

* cited by examiner

*Primary Examiner*—Brian Sircus
*Assistant Examiner*—Thanh-Tam Le
(74) *Attorney, Agent, or Firm*—Banner & Witcoff, Ltd.

(57) ABSTRACT

The invention permits a terminal retaining body provided with a retainer to fit smoothly into a cylindrical body.

A male housing 10 is formed by fitting an inner housing 30, in which a retainer 40 is attached, into a hood 12 of an outer housing 11. A protruding member 60 protrudes outwards from a right side of the hood 12, and a guiding groove 61 is formed in a concave manner from an anterior end of an inner face of the protruding member 60. A guiding member 62, which forms an inwardly inclining face, joins with the posterior of the guiding groove 61. If the retainer 40 protrudes from a side face of the inner housing 30 when this inner housing 30 is being fitted, the guiding member 62 engages with the retainer 40 while the inner housing 30 is being pushed inwards, and automatically pushes the retainer 40 inwards.

17 Claims, 13 Drawing Sheets

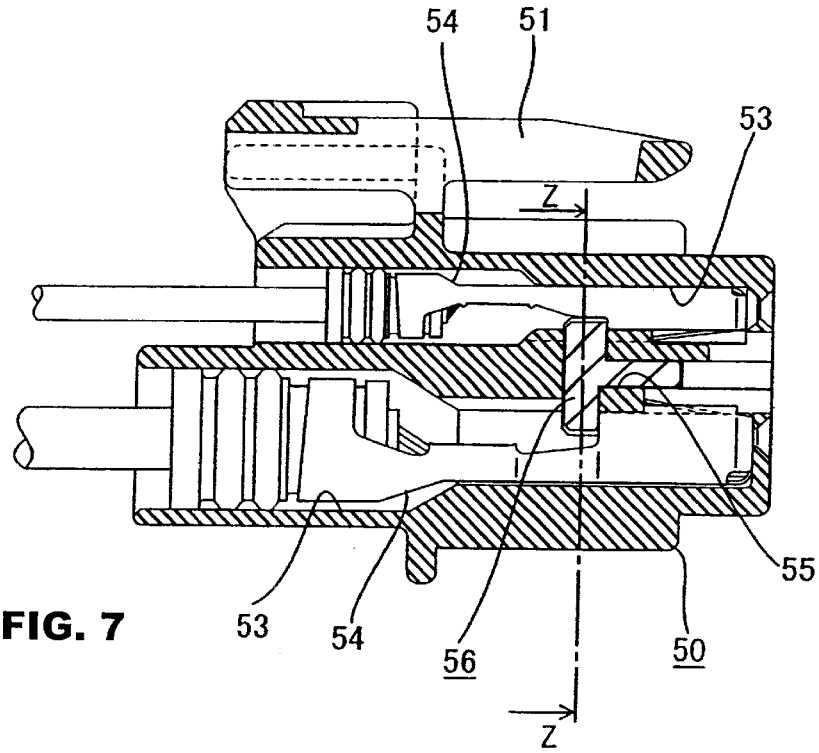
FIG. 7
FIG. 8
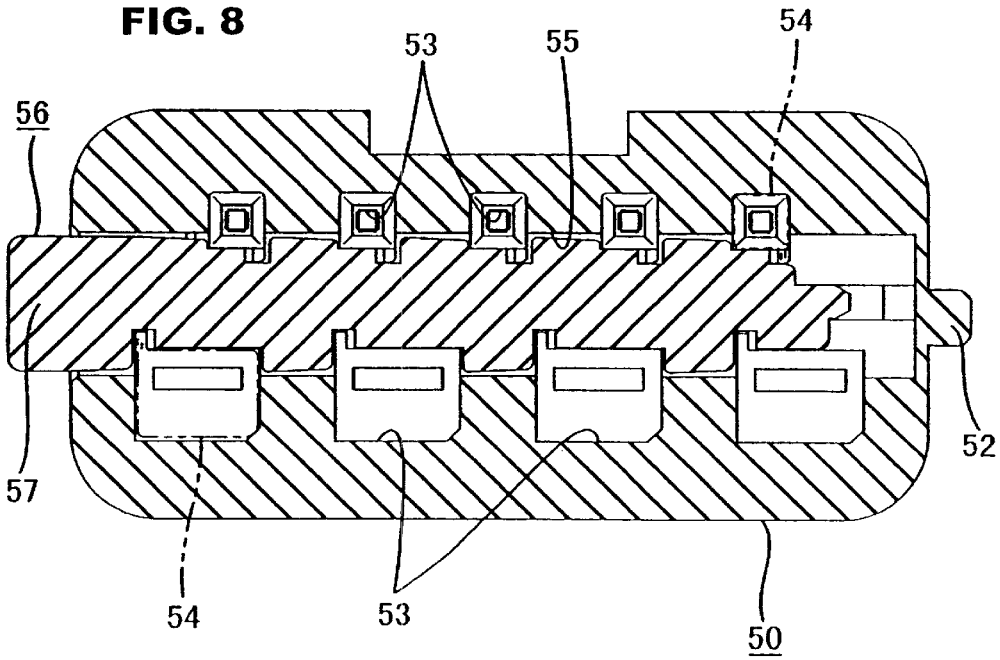

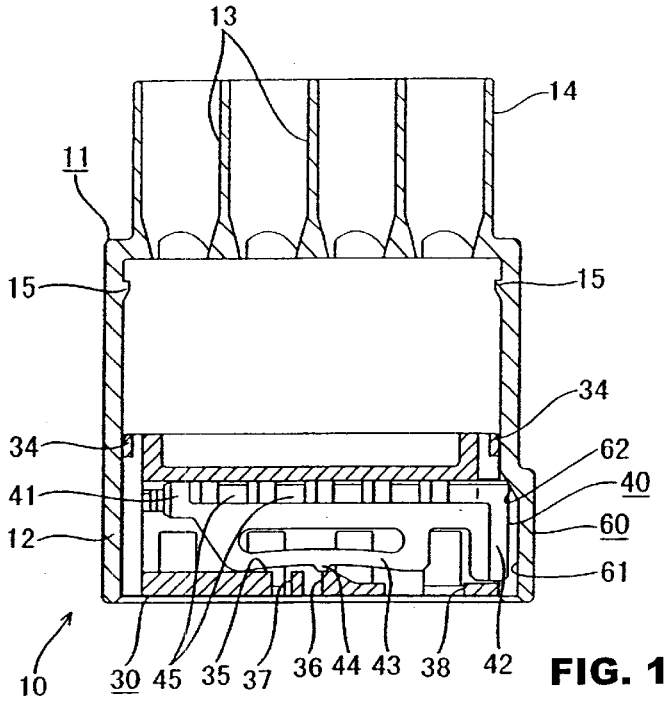
FIG. 13
FIG. 14
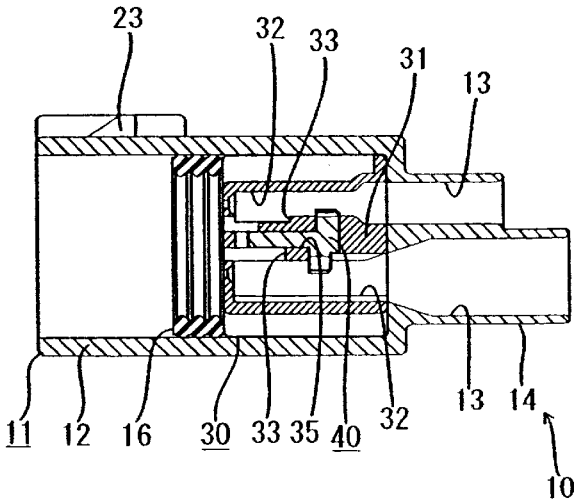
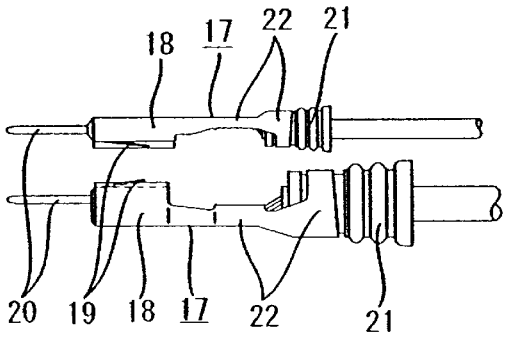

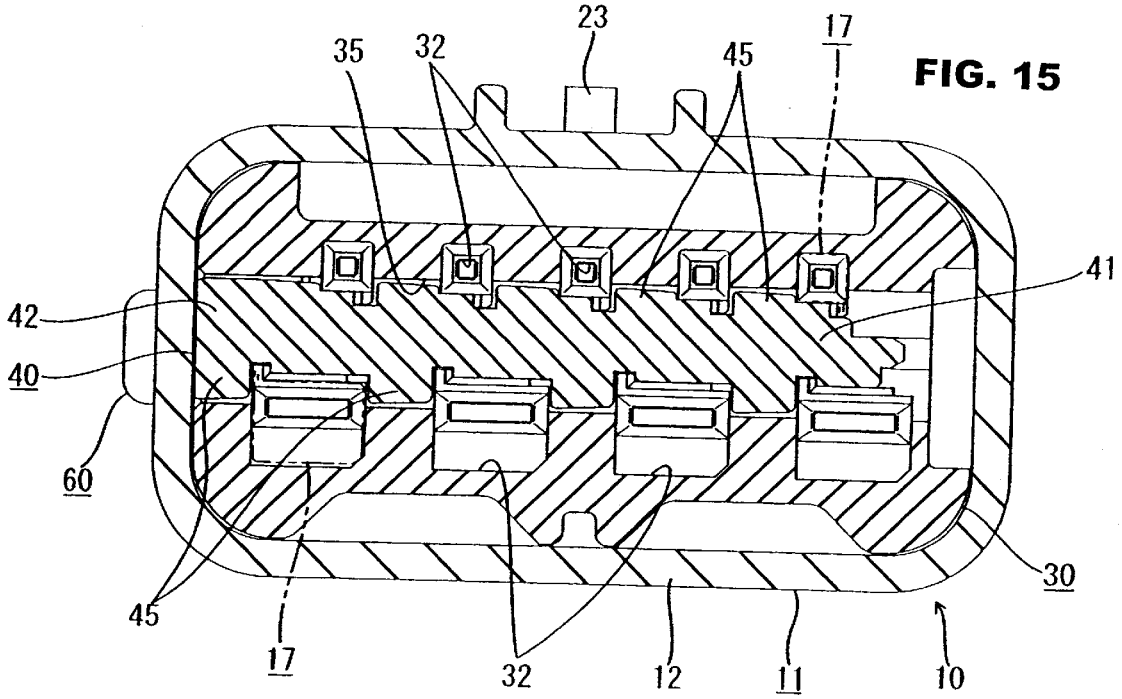
FIG. 15
FIG. 16
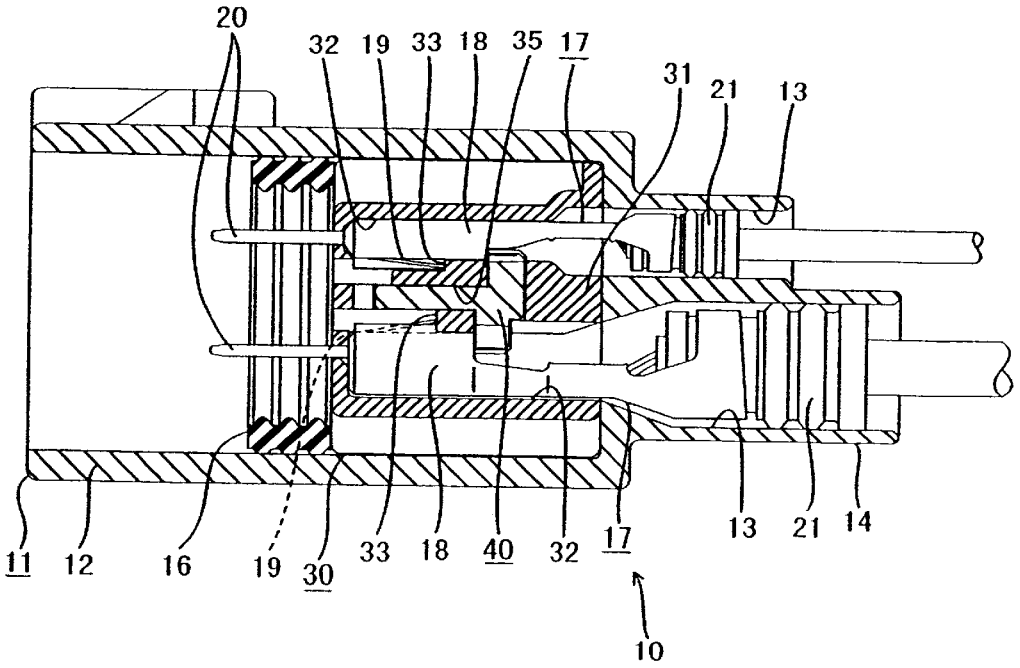

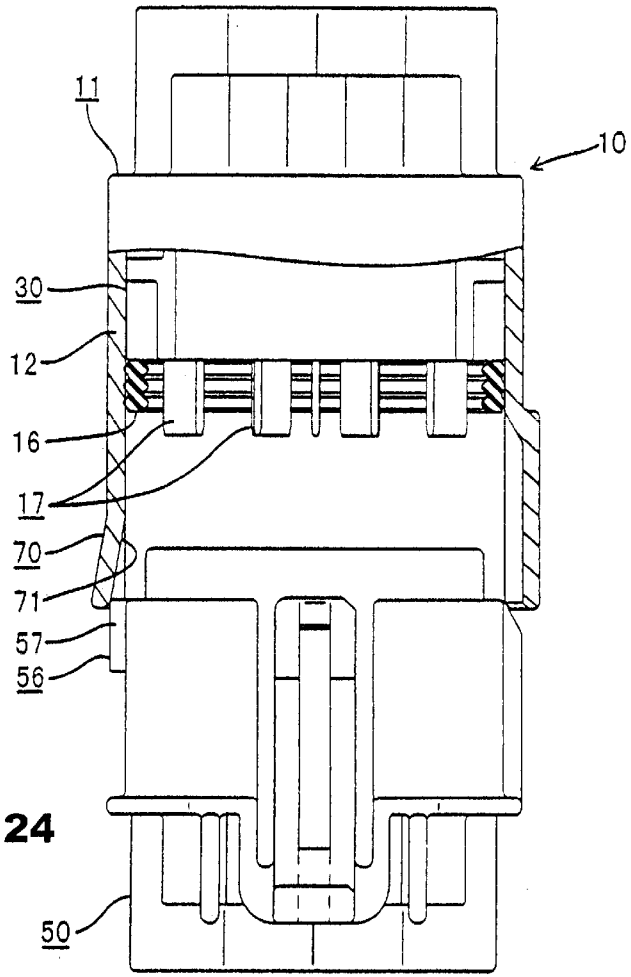
FIG. 24
FIG. 23
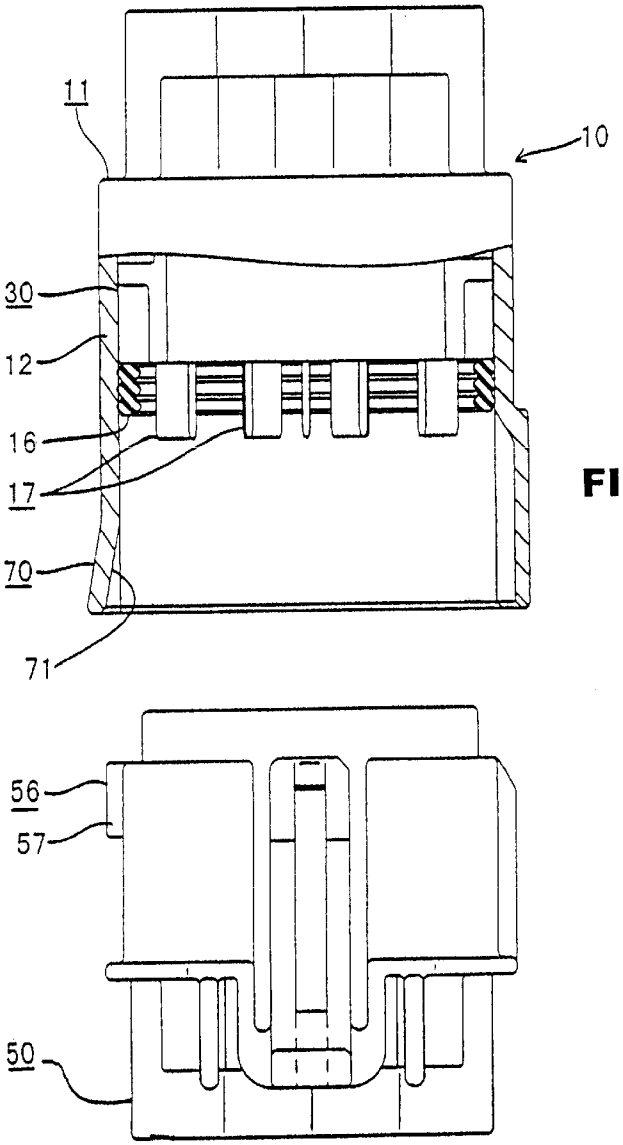

CONNECTOR WITH RETAINER MOVING GUIDE

TECHNICAL FIELD

The present invention relates to a connector having a terminal retaining body provided with cavities and located within a cylindrical body.

BACKGROUND TO THE INVENTION

This type of connector includes those having a connector housing formed in two pieces. One example thereof is described in JP-11-97096. As shown in FIG. 26 of this specification, this connector comprises a connector housing 1, consisting of a cylindrical outer housing 2 which is open to the anterior, and an inner housing 3 which fits within the outer housing 2. Cavities 5, into which terminal fittings 4 can be inserted are formed in the inner housing 3. A retainer attachment hole 6, which opens to the side of the cavities 5, is formed in the inner housing 3. A retainer 7 is inserted into the retainer attachment hole 6, thereby retaining the terminal fittings 4, which have been inserted into the cavities 5. The inner housing 3 is then housed within the outer housing 2.

The retainer 7 is sometimes inserted to an insufficient depth. The retainer 7 retains the terminal fittings 4 to a greater degree the more deeply it is inserted. Consequently, the terminal fittings 4 are poorly retained when the retainer 7 is inserted to an insufficient depth. Conventionally, a configuration has been used whereby an end of the retainer 7 protrudes to the exterior of a side face of the inner housing 3. If the inner housing 3 is fitted into the outer housing 2, the protruding portion of the retainer 7 strikes against an opening edge of the outer housing 2, thereby allowing the insufficient insertion of the retainer 7 to be detected.

However, although detection can be carried out reliably, an operation is required whereby the inner housing 3 is moved back, the retainer 7 is pushed in to the correct position, and the inner housing 3 is again fitted into the outer housing 2. This operation is cumbersome.

The present invention has taken the above problem into consideration, and aims to present a connector in which a terminal retaining body provided with a retainer can be fitted smoothly into a cylindrical body.

SUMMARY OF THE INVENTION

According to the invention there is provided an electrical connector comprising a terminal retaining body having cavities to receive electrical terminals, a retainer insertable into said terminal retaining body from a protruding to a non-protruding condition and adapted to retain electrical terminals therein, and a tubular housing to receive the terminal retaining body and retainer therein, characterised in that a first guiding member is provided on the inner face of said tubular housing, the first guiding member being adapted to engage said retainer in a protruding condition, to urge said retainer to a non-protruding condition as the terminal retaining body is received within said tubular housing.

Such an arrangement ensures that a slightly protruding retainer will not impede insertion of the terminal retaining body into the tubular housing.

The housing preferably is approximately rectangular, the first guiding member being about half way along one side thereof.

By having the retainer opening within the tubular housing, the connector is easier to waterproof.

Preferably the first guiding member comprises a tapered face, most preferably a tapered face in a channel of the tubular housing.

In a preferred embodiment a mating connector is insertable in the tubular housing for electrical engagement with the terminal retaining body, and this mating connector has a protrusion engageable in the channel of the tubular housing.

Thus the channel and first guiding member are moulded together in a single location. This simplifies the configuration of the connector.

The tubular housing may include a second guiding member to urge a retainer of the mating connector into a non-protruding condition. Preferably the first and second guiding members are opposite.

BRIEF DESCRIPTION OF DRAWINGS

Other features of the invention will be apparent from the following description of several preferred embodiments shown by way of example only in the accompanying drawings in which:

FIG. 7 is a cross-sectional view of the female housing.

FIG. 8 is a cross-sectional view along the line Z—Z of FIG. 7 showing the retainer in a temporary retaining position.

FIG. 13 is a cross-sectional view along the line X—X of FIG. 2 showing the retainer being pushed by the guiding member into the temporary retaining position.

FIG. 14 is a cross-sectional view showing female terminal fittings being inserted into both cavities.

FIG. 15 is a cross-sectional view along the line Y—Y of FIG. 2 showing stopping protrusions in a state whereby they are distant from inner cavities.

FIG. 16 is a cross-sectional view showing male terminal fittings being inserted into both cavities.

FIG. 23 is a partially cut-away plan view showing male and female housings of the second embodiment of the present invention.

FIG. 24 is a partially cut-away plan view showing a female retainer being pushed into the main retaining position by a second guiding member.

DESCRIPTION OF PREFERRED EMBODIMENTS

Figure 1:
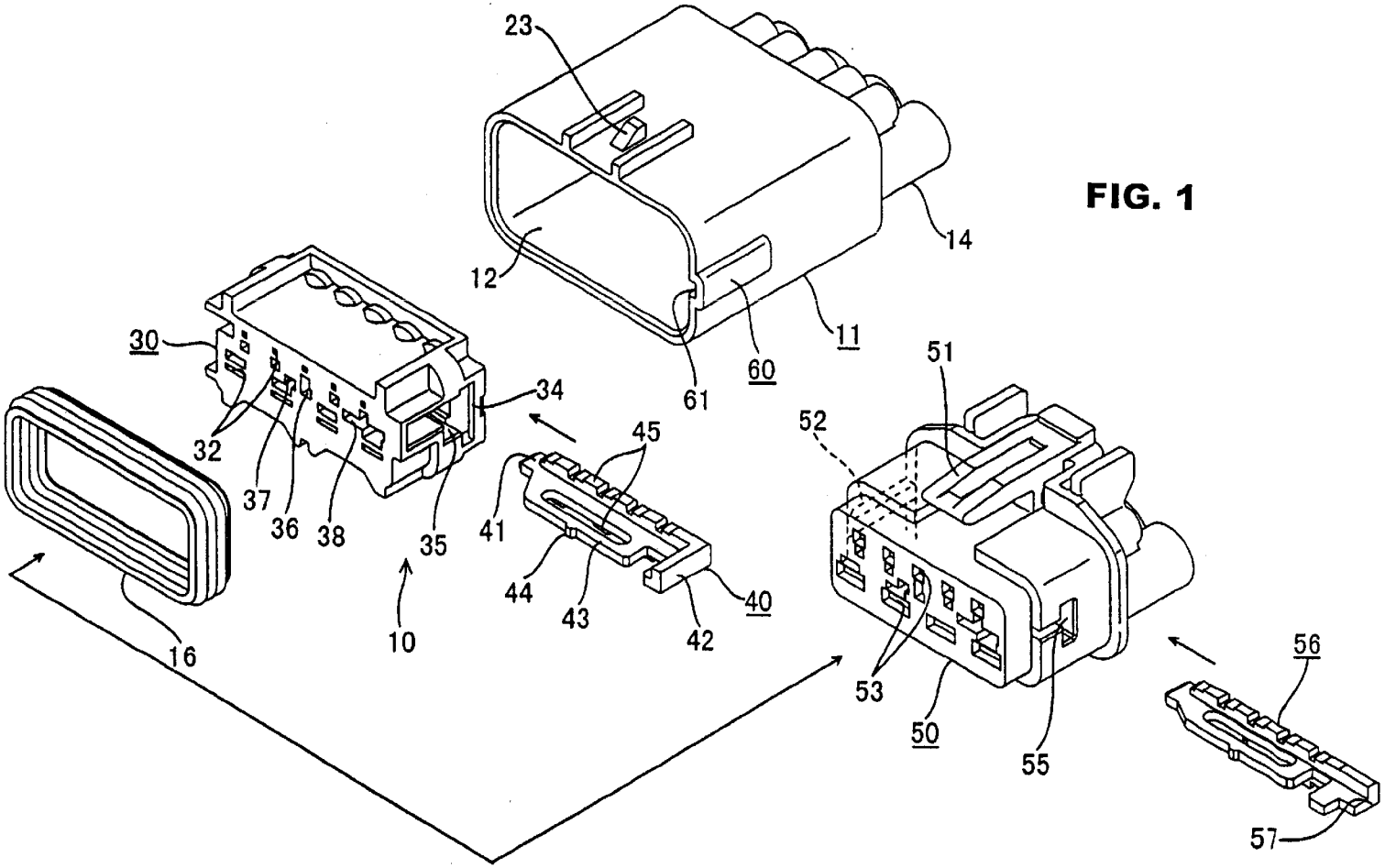
FIG. 1 is a disassembled diagonal view of a waterproof connector of a first embodiment of the present invention.

A first embodiment of the present invention is described below with the aid of FIGS. 1 to 22. As shown in FIG. 1, a waterproof connector is formed from a male connector housing 10 and a female connector housing 50. The male housing 10 comprises an inner housing 30 fitting within a cylindrical outer housing 11.

Figure 2:
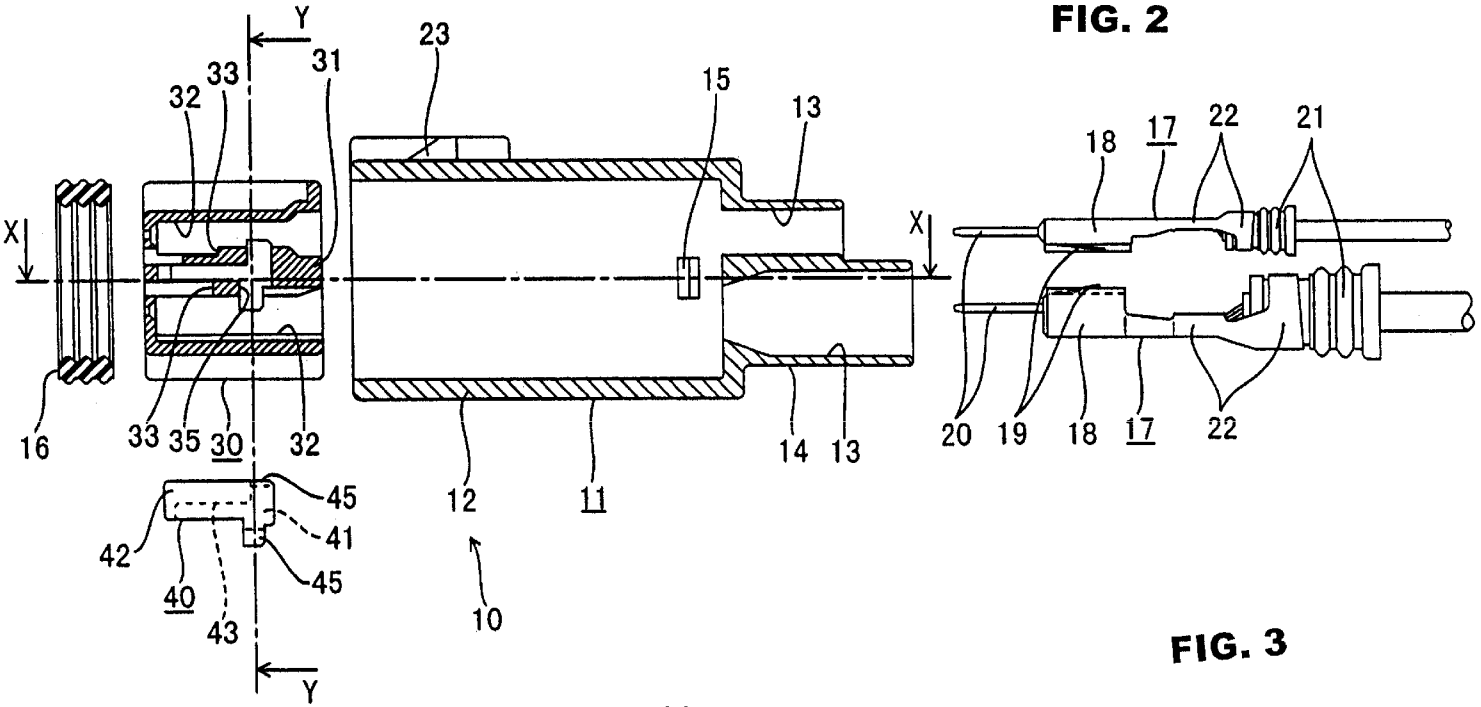
FIG. 2 is a disassembled cross-sectional view of a male housing.
Figure 10:
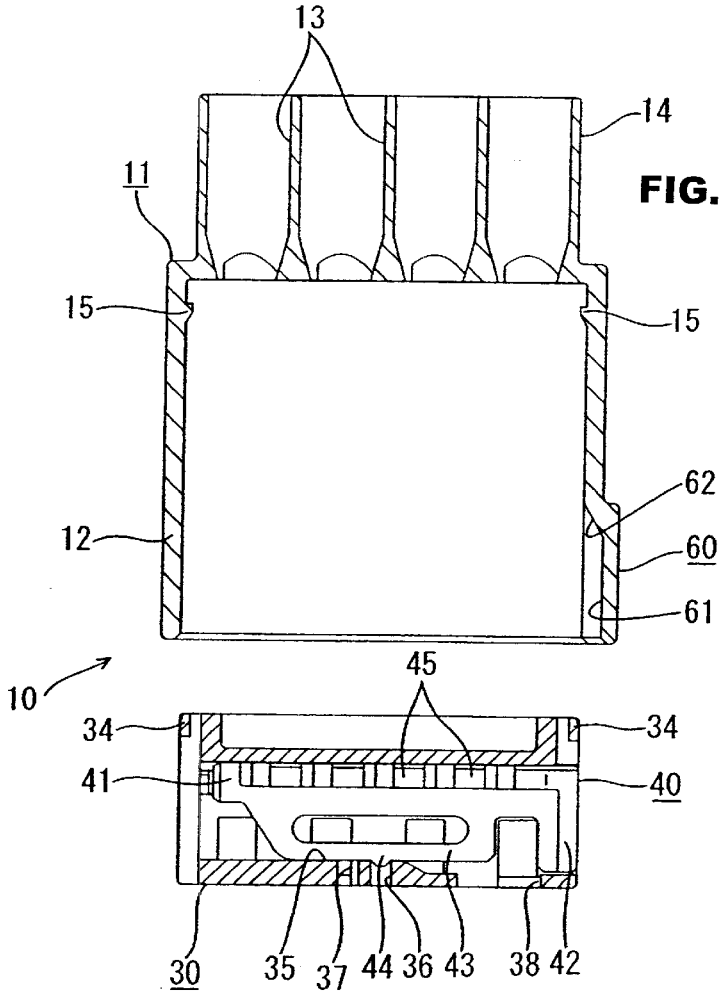
FIG. 10 is a cross-sectional view along the line X—X of FIG. 2 showing the retainer in the temporary retaining position.

As shown in FIGS. 1 and 2, the outer housing 11 has an approximately cylindrical shape and is provided with a hood 12 which is open to the anterior. Terminal housing chambers 14 are formed in the posterior side of the outer housing 1. These terminal housing chambers 14 are provided with an upper and lower layer of outer cavities 13 into which male terminal fittings 17 can be inserted. The lower layer of the outer cavities has four mutually aligned large chambers, and the upper layer has five mutually aligned small chambers. The hood 12 is formed so that the inner housing 30 can be fitted therein. As shown in FIG. 10, a pair of fitting protrusions 15 are formed on innermost sides of inner faces of the hood 12. These fit with fitting members 34 formed on the inner housing 30, thereby maintaining the inner housing 30 in a fitted state with the hood 12. A rubber ring 16 is attached to the immediate anterior of the inner housing 30, this fitting tightly with an inner circumference face of the hood 12.

As shown in FIG. 2, the inner housing 30 is provided with an upper and lower layer of inner cavities 32, a separating wall 31 being provided therebetween at an approximately central location relative to the up-down direction of the inner housing 30. As shown in FIG. 14, these inner cavities 32 pass through, at their posterior, to the outer cavities 13 when the inner housing 30 is in a fitted state within the outer housing 11. The male terminal fittings 17, which have been passed through the outer cavities 13, are housed within these inner cavities 32. A lance 19, formed on a box member 18 of each male terminal fitting 17, is capable of engaging resiliently with a stopping groove 33 formed in an inner face of each inner cavity 32. Each male terminal fitting 17 is provided with a tab 20 and a barrel member 22. The tab 20 is formed at the anterior side of the box member 18. The barrel member 22 has a rubber stopper 21 clamped thereto, an electric wire being attached to this rubber stopper 21. The rubber stoppers 21 fit tightly with inner circumference faces of the outer cavities 13, thereby waterproofing the cavities 13 and 32.

Figure 3:
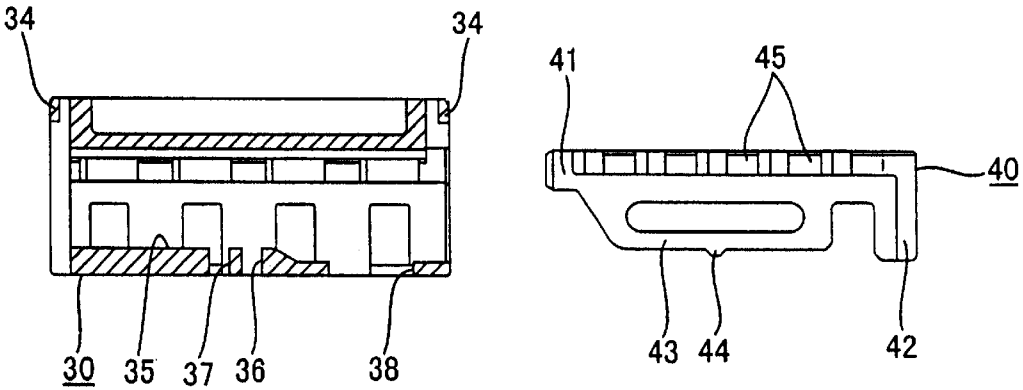
FIG. 3 is a cross-sectional view along the line X—X of FIG. 2 showing an inner housing and a retainer.

As shown in FIG. 3, posterior ends of the side faces of the inner housing 30 have the pair of fitting members 34 formed thereon. A retainer attachment hole 35, which opens onto both side faces of the inner housing 30, is formed to the anterior of the fitting members 34. A retainer 40 can be inserted into this retainer attachment hole 35 from the right side (relative to FIG. 3). As shown in FIGS. 2 and 3, the retainer attachment hole 35 passes through the separating wall 31 in a width-wise direction thereof, and lower faces of the upper cavities 32 and upper faces of the lower cavities 32 open onto this retainer attachment hole 35. As shown in FIG. 3, a temporary retaining hole 36 and a main retaining hole 37, both being open to the anterior, are formed in a wall portion located towards the anterior side of the retainer attachment hole 35. The temporary retaining hole 36 and the main retaining hole 37 are formed in an approximately central location relative to the width-wise direction of the wall portion, and are aligned from right to left relative to FIG. 3. A retaining protrusion 44 of the retainer 40 engages with the temporary retaining hole 36 or the main retaining hole 37, thereby allowing the retainer 40 to be maintained at either of two separate locations along the width-wise direction of the retainer attachment hole 35. Furthermore, a retainer operating hole 38 is provided to the right (relative to FIG. 3) of the temporary retaining hole 36. A jig or the like can be inserted via this retainer operating hole 38 in order to operate the retainer 40 within the retainer attachment hole 35.

As shown in FIGS. 1 and 3, the retainer 40 is provided with a long and narrow plate-shaped main body 41. A pressing operating member 42 protrudes towards the anterior from a right edge (relative to FIG. 3) of the main body 41. This pressing operating member 42 allows a pressing operation while the retainer 40 is attached to the inner housing 30. An arch-shaped bending member 43 protrudes from an anterior face of the main body 41 at a location to the left of the pressing operating member 42 (a space remains between the bending member 43 and the pressing operating member 42). The retaining protrusion 44 protrudes from the centre of an anterior face of the bending member 43. When the retainer 40 is to be moved within the retainer attachment hole 35, the retaining protrusion 44 is pressed, thereby bending the centre of the bending member 43 in a concave manner (see FIG. 12).

Figure 4:
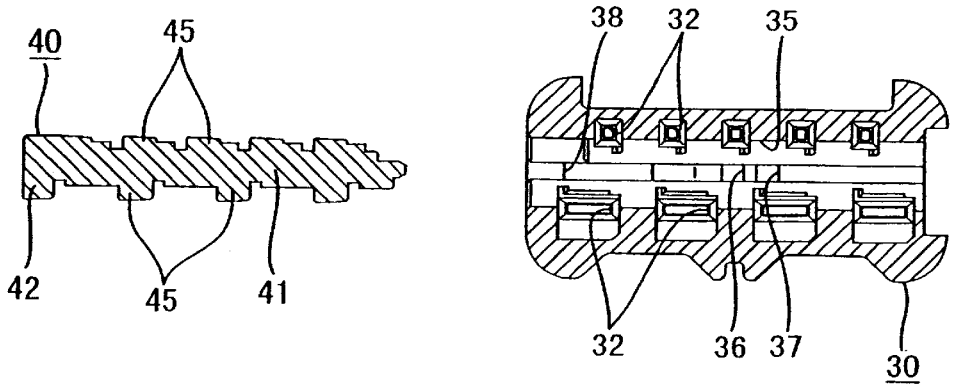
FIG. 4 is a cross-sectional view along the line Y—Y of FIG. 2 showing the inner housing and the retainer.

As shown in FIG. 4, stopping protrusions 45 protrude from upper and lower faces of the main body 41. Four stopping protrusions 45 are formed on the lower face, and five stopping protrusions 45 are formed on the upper face, these stopping protrusions 45 being formed in locations which correspond to spaces between the inner cavities 32. The stopping protrusions 45 engage with the male terminal fittings 17 which have been inserted into the inner cavities 32. As shown in FIG. 10, when the retainer 40 is inside the inner housing 30 and the retaining protrusion 44 is in a location whereby it engages with the temporary retaining hole 36, the stopping protrusions 45 are distant from the inner cavities 32 (shown in FIG. 15). This allows the male terminal fittings 17 to be inserted into or removed from the inner cavities 32. At this juncture, the retainer 40 is in a temporary retaining position. When the retainer 40 is in this temporary retaining position, an outer side face of the pressing operating member 42 thereof is located so as to form an approximately unified face with a side face of the inner housing 30.

Figure 17:
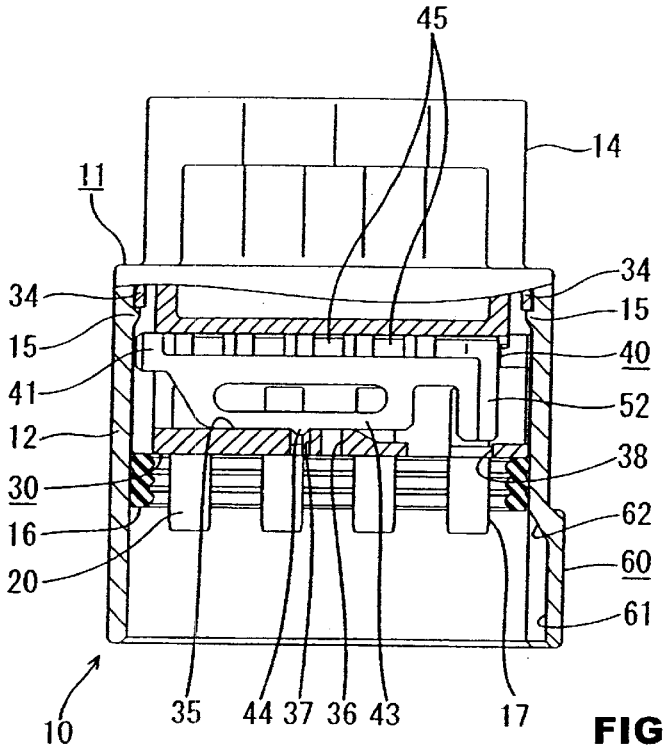
FIG. 17 is a cross-sectional view along the line X—X of FIG. 2 showing the retainer in a state whereby it has been moved into the main retaining position.
Figure 18:
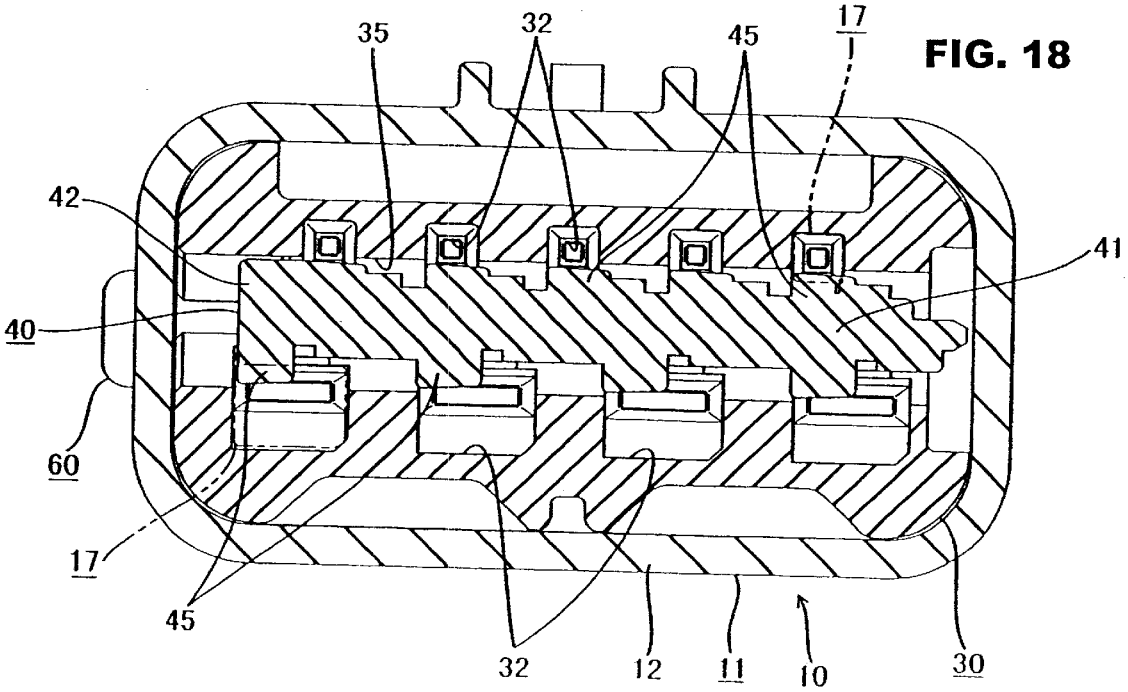
FIG. 18 is a cross-sectional view along the line Y—Y of FIG. 2 showing the stopping protrusions in a state whereby they have been inserted into the inner cavities.
Figure 19:
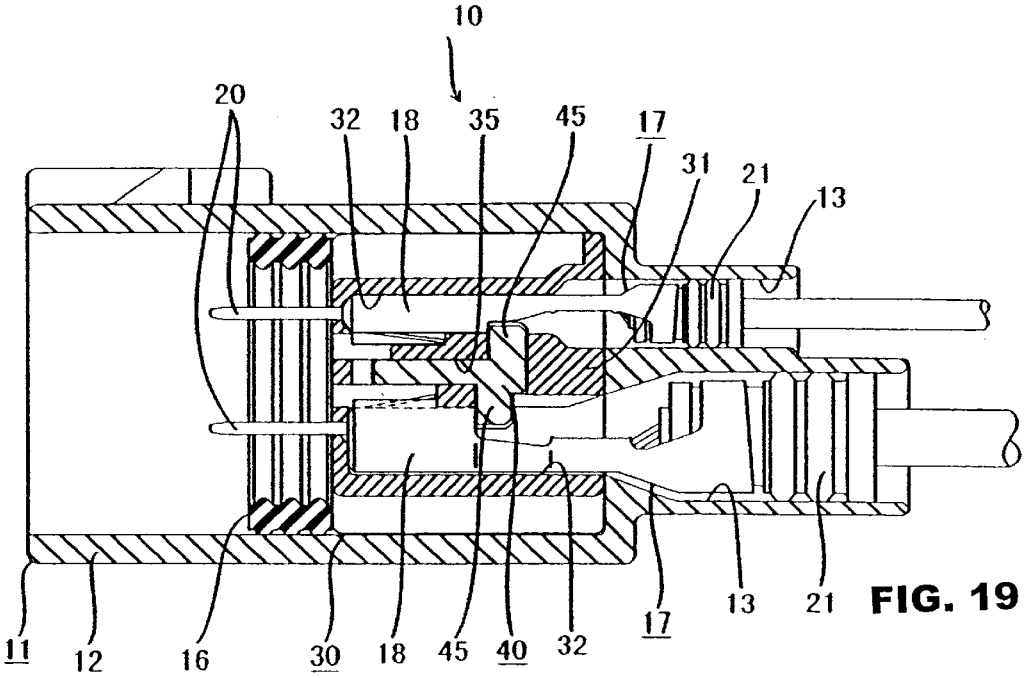
FIG. 19 is a cross-sectional view of the male terminal fittings retained by the retainer which is in the main retaining position.

As shown in FIG. 17, when the retainer 40 is inside the inner housing 30 and the retaining protrusion 44 is in a location whereby it engages with the main retaining hole 37, the stopping protrusions 45 come to be located in the inner cavities 32 (see FIG. 18) and engage with posterior ends of the box members 18 of the male terminal fittings 17. At this juncture, the retainer 40 is in a main retaining position. When the retainer 40 is in this main retaining position, the outer side face of the pressing operating member 42 thereof is located inwards relative to the side face of the inner housing 30.

Next, the female housing 50 will be explained. As shown in FIG. 1, the female housing 50 is capable of being fitted within the hood 12 of the outer housing 11. A locking arm 51 formed on an upper face of the female housing 50 is locked by a locking protrusion 23 provided on an upper face of the outer housing 11, thereby maintaining the female housing 50 in a fitted state with the outer housing 11. An anterior end of the female housing 50 is reduced in diameter, having a stepped shape. After the female housing 50 has been fitted, the rubber ring 16 fits tightly with a circumference face of the reduced diameter portion (see FIG. 22).

Figure 5:
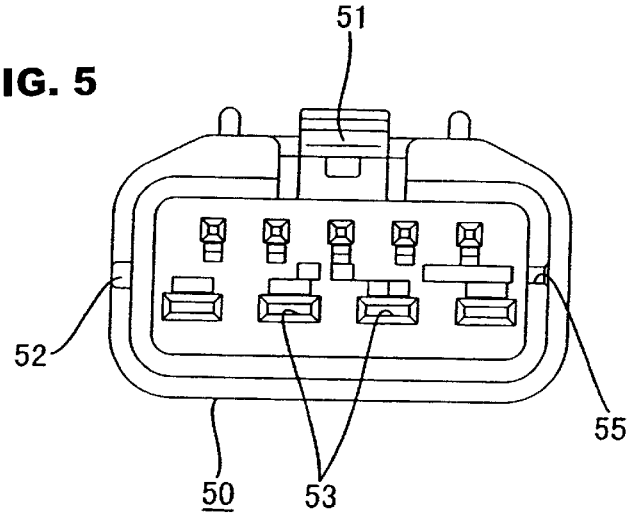
FIG. 5 is a front view of a female housing.
Figure 6:
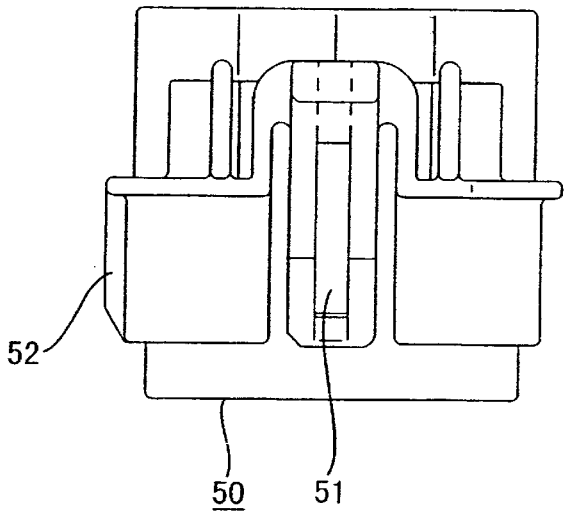
FIG. 6 is a plan view of the female housing.

As shown in FIGS. 5 and 6, a rib 52 protrudes outwards from a left side face (relative to FIGS. 5 and 6) at a posterior end of the reduced diameter portion. This rib 52 is provided at an approximately central location, relative to the up-down direction of the female housing 50, and extends from an anterior edge of the wider diameter portion to an approximately central location relative to the length-wise direction of the female housing 50. An anterior end face of this rib 52 is tapered.

As shown in FIG. 7, cavities 53 are formed inside the female housing 50 at locations which correspond to the inner cavities 32 of the male housing 10. Female terminal fittings 54 which have been inserted into the cavities 53 make contact with the tabs 20 of the corresponding male terminal fittings 17. The female terminal fittings 54 have approximately the same configuration as the male terminal fittings 17, with the difference that they do not have tabs 20. Consequently, a description of the female terminal fittings 54 is omitted. Furthermore, the configuration of the cavities 53 is approximately the same as that of the male inner cavities 32 and of the outer cavities 13, and a description thereof is omitted.

As shown in FIG. 1, a retainer attachment hole 55 opens onto a side face of the female housing 50 at the side opposite that provided with the rib 52. As is the case with the male housing 10, a retainer 56 can be inserted into this retainer attachment hole 55. The retainer 56 has approximately the same configuration as the male retainer 40, and accordingly a description thereof is omitted. As shown in FIG. 8, when the retainer 56 is maintained in a temporary retaining position which allows the female terminal fittings 54 to be inserted into or removed from the cavities 53, a pressing operating member 57 of the retainer 56 protrudes for a specified distance from a side face of the female housing 50.

Figure 9:
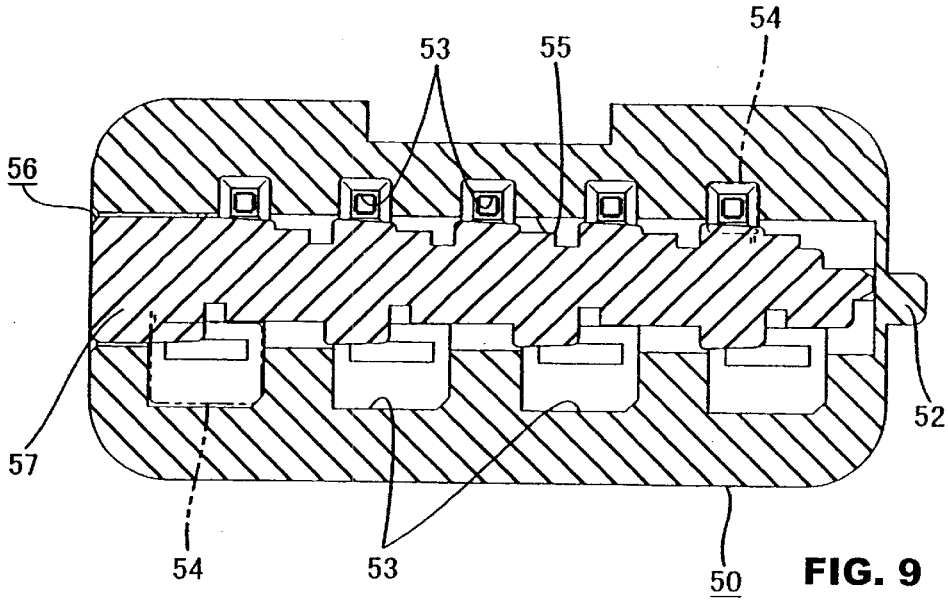
FIG. 9 is a cross-sectional view along the line Z—Z of FIG. 7 showing the retainer in a main retaining position.

As shown in FIG. 9, when the retainer 56 is maintained in a main retaining position which retains the female terminal fittings 54, an outer side face of the pressing operating member 57 forms an approximately unified face with the side face of the female housing 50.

As shown in FIG. 1, a protruding member 60 protrudes outwards from the hood 12 of the outer housing 1 of the male housing 10. This protruding member 60 is formed at a right side (relative to FIG. 1) of the hood 12, at an approximately central location relative to the up-down direction thereof. The protruding member 60 extends from the anterior end face of this hood 12 and extends for approximately one third of the entire length thereof.

Figure 12:
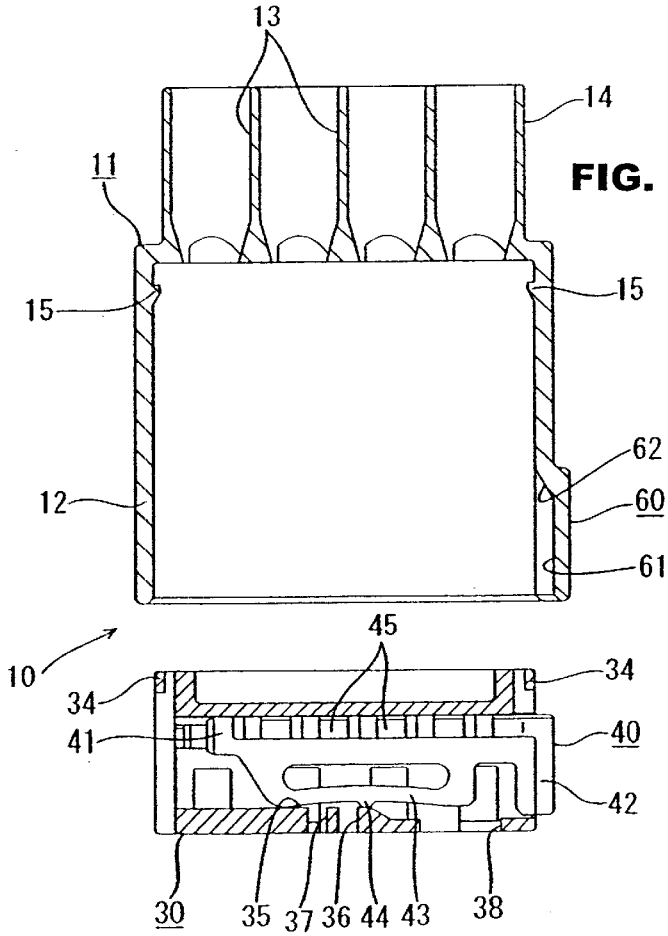
FIG. 12 is a cross-sectional view along the line X—X of FIG. 2 showing the retainer protruding from a side face of the inner housing.
Figure 20:
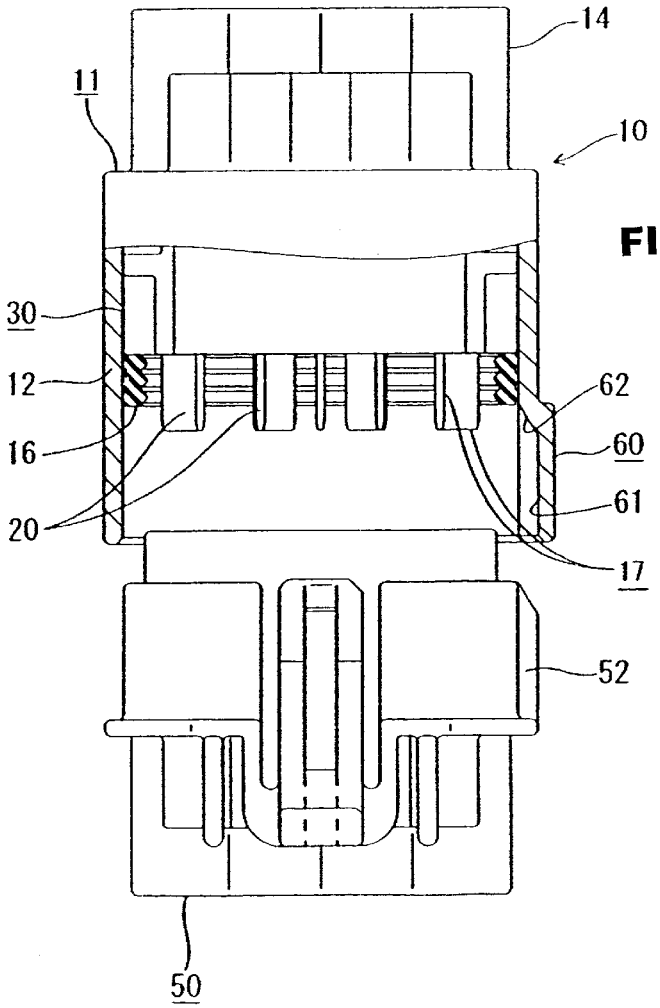
FIG. 20 is a partially cut-away plan view showing the male and female housings prior to being fitted together.

As shown in FIG. 20, a guiding groove 61, which allows the rib 52 of the female housing 50 to be inserted, is formed in a concave manner in an inner face of the protruding member 60. As shown in FIG. 1, this guiding groove 61 is formed at approximately the same height as the rib 52 of the female housing 50 and the retainer 40 which is inserted into the inner housing 30. As shown in FIG. 12, the guiding groove 61 allows insertion to take place even if the pressing operating member 42 of the retainer 40 protrudes, to a certain degree, from the side face of the inner housing 30.

Figure 22:
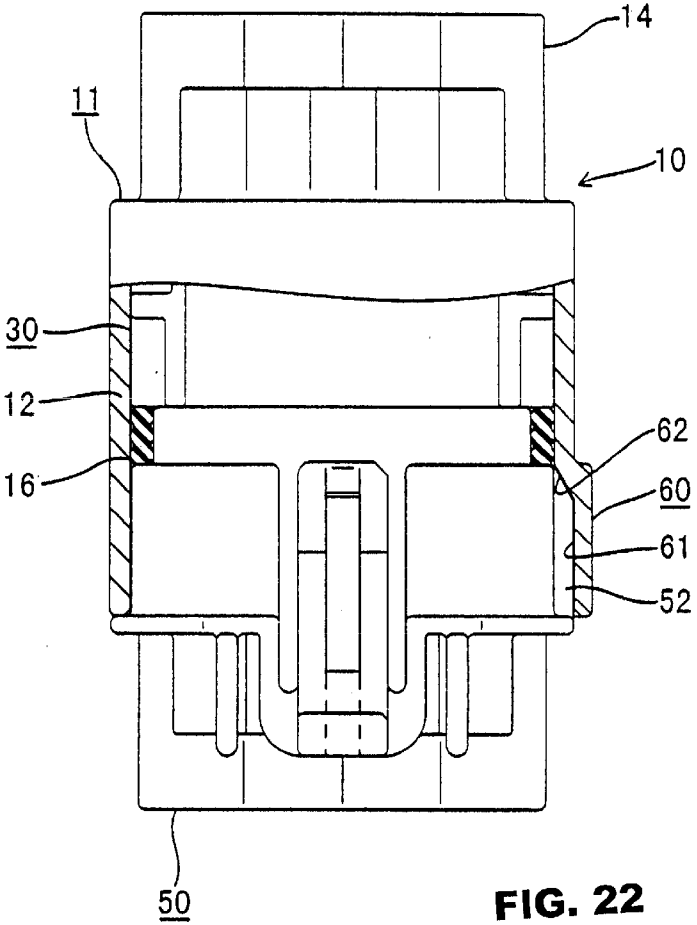
FIG. 22 is a partially cut-away plan view showing the male and female housings in a correctly fitted state.

A guiding member 62 joins with the posterior of the guiding groove 61. This guiding member 62 forms an inwardly inclining face. The guiding member 62 has a tapered shape, protruding slightly inwards from a location immediately to the posterior of the guiding groove 61 to an innermost end of the inner face of the protruding member 60. The posterior end thereof joins with a posterior side inner face of the hood 12. An end of the pressing operating member 42 of the retainer 40 which has been inserted into the guiding groove 61 is capable of making contact with the guiding member 62, the retainer 40 being pressed inwards by the guiding member 62 as the insertion operation progresses (see FIG. 13). The angle of inclination of the guiding member 62 corresponds to the angle of inclination of the anterior end face of the rib 52 of the female housing 50. As shown in FIG. 22, the anterior end face of the rib 52 makes contact with the guiding member 62 when the female housing 50 has been correctly fitted. When the inner housing 3 is fitted within the hood 12 and the rubber ring 16 is in a fitted state, a posterior end of the guiding member 62 is located in approximately the same location as an anterior face of this rubber ring 16.

Figure 11:
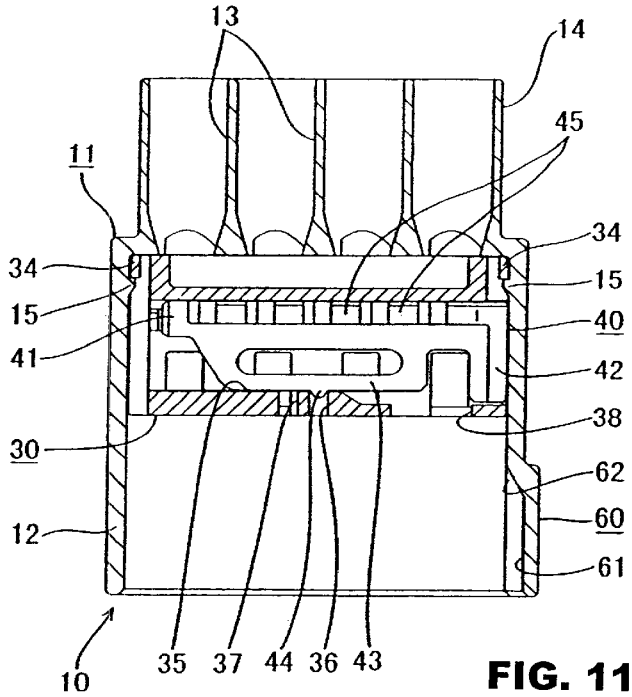
FIG. 11 is a cross-sectional view along the line X—X of FIG. 2 showing an inner housing and an outer housing in a fitted state.

The present embodiment is configured as described above. Next, the order of assembly of the male housing 10 and the fitting operation of the male and female housings 10 and 50 will be described. First, as shown in FIG. 10, the retainer 40 is inserted into the inner housing 30 as far as the temporary retaining position, whereby the outer side face of the pressing operating member 42 forms an approximately unified face with a side face of the inner housing 30. Then the inner housing 30 is fitted into the hood 12 of the outer housing 11. Next, as shown in FIG. 11, the inner housing 30 is fitted to a depth whereby its fitting members 34 engage with the fitting protrusions 15 within the hood 12. Then the rubber ring 16 is attached to an anterior side of the inner housing 30.

If the retainer 40 is not inserted to a sufficient depth when it is inserted to this temporary retaining position, the pressing operating member 42 of the retainer 40 protrudes from the side face of the inner housing 30 (shown in FIG. 12). If the degree to which the retainer 40 protrudes is sufficient to allow it to be inserted into the guiding groove 61, and the operator fits the inner housing 30 into the outer housing 11 without noticing that the retainer 40 is protruding, the protruding end of the retainer 40 engages with the guiding member 62. As shown in FIG. 13, the protruding end of the retainer 40 is pushed inwards by the guiding member 62 while the inner housing 30 is being pushed inwards and, as shown in FIG. 11, the side face of the pressing operating member 42 of the retainer 40 forms an approximately unified face with the side face of the inner housing 30. In this manner, the guiding member 62 automatically moves the retainer 40 into the correct temporary retaining position as the fitting operation of the inner housing 30 progresses.

The retainer 40, while still being capable of being inserted into the guiding groove 16, may protrude to such a small extent that it is difficult for the operator to detect visually whether it is protruding prior to the fitting operation. However, as long as the retainer 40 protrudes to the extent that its protruding end makes contact with the anterior end face of the hood 12, the operator can easily detect this protruding state before the fitting operation commences.

As shown in FIG. 14, after the inner housing 30 has been fitted, the male terminal fittings 17 are inserted into the outer cavities 13 and the inner cavities 32 while these are in a joined state. As shown in FIG. 15, the retainer 40 is in the temporary retaining position at this juncture. The stopping protrusions 45 are distant from the inner cavities 32 and, as shown in FIG. 16, the male terminal fittings 17 can be inserted as far as a position in which the lances 19 engage with the stopping grooves 33. After the male terminal fittings 17 have been inserted, a jig or the like is inserted into the retainer operating hole 38 from the anterior of the hood 12, and the side face of the bending member 43 is pressed, thereby moving the retainer 40 into the main retaining position (see FIG. 17). By this means, the stopping protrusions 45 engage with the posterior ends of the box members 18, thereby doubly retaining the male terminal fittings 17 (see FIGS. 18 and 19).

Figure 21:
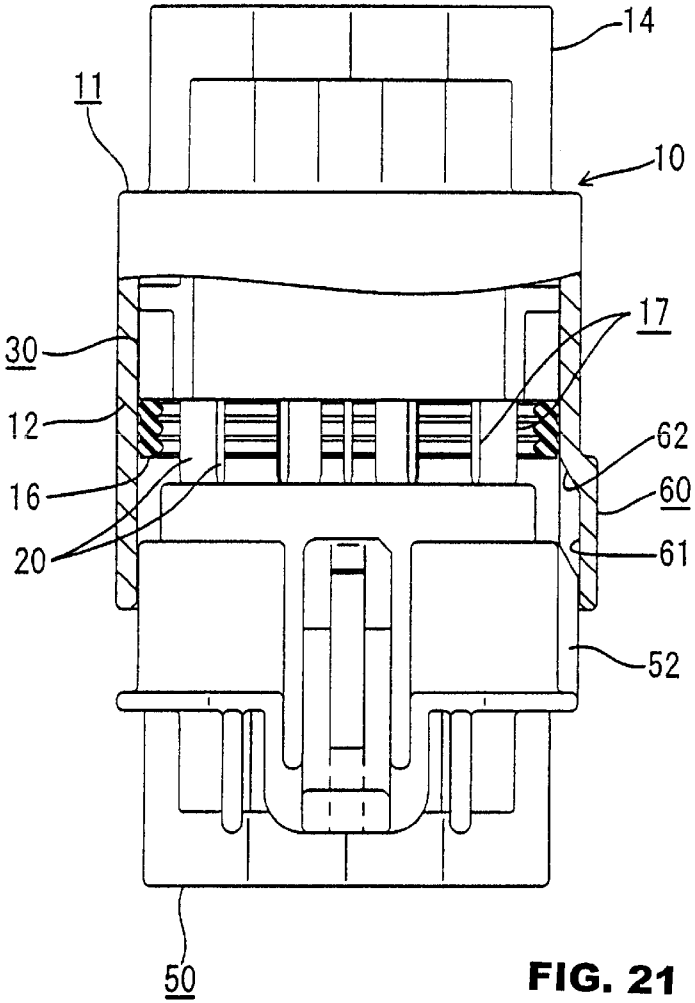
FIG. 21 is a partially cut-away plan view showing the male and female housings being fitted together.

After the male housing 10 has been assembled in this manner, the female housing 50 is fitted into the hood 12 (see FIG. 20). As shown in FIG. 21, the rib 52 is inserted into the guiding groove 61 as the male and female housings 10 and 50 are fitted together. As a result, the fitting operation is guided smoothly. As shown in FIG. 22, when this fitting operation has reached a depth whereby the anterior face of the female housing 50 makes contact with the anterior face of the rubber ring 16, the locking arm 51 is locked by the locking protrusion 23, thereby maintaining the male and female housings 10 and 50 in an inseparable state.

According to the embodiment described above, the guiding member 62 automatically pushes the protruding retainer 40 into the correct temporary retaining position while the fitting operation of the inner housing 20 progresses. As a result, retainers 40 which protrude do not need to be moved individually, and the operation can be performed smoothly. Furthermore, the guiding member 62 is provided immediately inwards from the guiding groove 61. Consequently, the parts for correcting the movement of the retainer 40 and the parts for guiding the fitting operation of the male and female housings 10 and 50 are gathered in one location of the circumference, and the configuration is thereby simplified.

The male housing 10 is divided into the outer housing 11 and the inner housing 30. As a result, the opening into which the retainer 40 is inserted does not open onto the exterior.

A second embodiment of the present invention is now described below with the aid of FIGS. 8, 9, 23 and 24. The second embodiment describes a means to correct the movement of the retainer attached to the female housing which is fitted within the male housing.

As shown in FIG. 23, a protruding member 70 protrudes outwards from a hood 12 of an outer housing 11 of a male housing 10. This protruding member 70 is formed at a left side (relative to FIG. 23) of the hood 12. That is, it is formed at the same side as a retainer attachment hole 55 into which a retainer 56 of a female housing 50 (which is fitted into the hood 12) is inserted. A guiding member 71 is formed on an inner face of the protruding member 70. This guiding member 71 forms an inwardly inclining face. The guiding member 71 is formed at approximately the same height as the retainer 56 which is inserted into the retainer attachment hole 55 of the female housing 50. The guiding member 71 is capable of making contact with the retainer 56 even if this retainer 56 protrudes from the side face of the female housing 50.

Prior to the male and female housings 10 and 50 being fitted together, the retainer 56 is inserted to a temporary retaining position in the retainer attachment hole 55 of the female housing 50, a pressing operating member 57 protruding from the side face of the female housing 50 (see FIG. 8). In this state, female terminal fittings 54 are inserted into cavities 53. Then the retainer 56 is moved to a main retaining position, in which the outer side face of the pressing operating member 57 of the retainer 56 forms an approximately unified face with the side face of the female housing 50 (see FIG. 9), thereby doubly retaining the female terminal fittings 54.

In the second embodiment, the main retaining position of the female retainer 56 corresponds to the correct attachment permitting position of the Claims.

If the retainer 56 is not inserted to a sufficient depth when it is moved to the main retaining position, the pressing operating member 57 of the retainer 56 may protrude from the side face of the female housing 50 (see FIG. 23). If the male and female housings 10 and 50 are fitted together from this state, the protruding end of the pressing operating member 57 of the retainer 56 engages with the guiding member 71, and this guiding member 71 pushes the retainer 56 inwards as the fitting progresses (see FIG. 24). By this means, the retainer 56 can automatically be moved into the correct main retaining position as the male and female housings 10 and 50 are fitted together.

The length of the guiding member 71 in the direction of fitting is such that it is capable of moving the retainer 56 into the main retaining position before the male and female terminal fittings 17 and 54 begin to make contact. By this means, the female terminal fittings 54 make contact with the male terminal fittings 17 in a state whereby they are doubly retained, and are reliably prevented from being removed.

A third embodiment of the present invention is now described below with the aid of FIG. 25. The third embodiment shows a guiding member having a different shape from that of the second embodiment.

Figure 25:
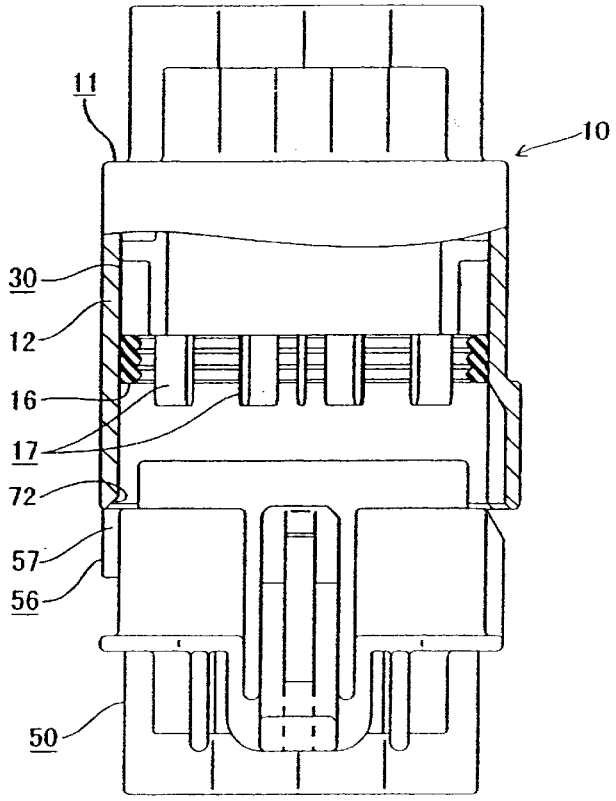
FIG. 25 PRIOR ART
FIG. 25 is a partially cut-away plan view showing male and female housings of the third embodiment of the present invention.
Figure 26:
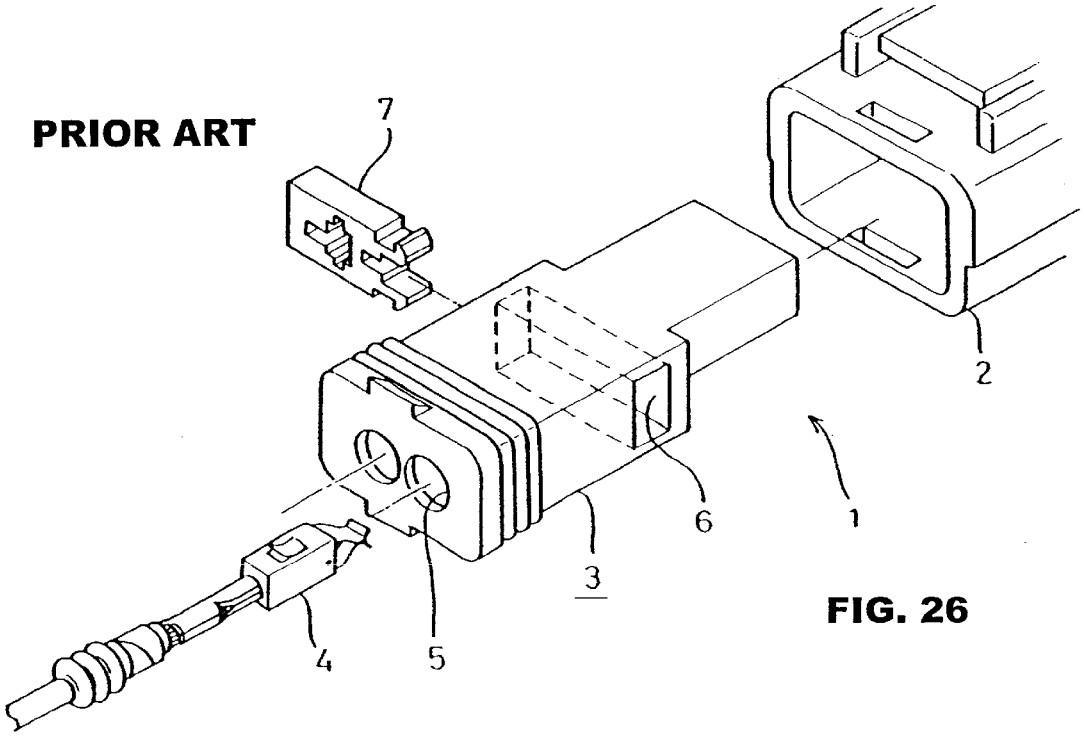
FIG. 26 is a diagonal view of a prior art example.

As shown in FIG. 25, a guiding member 72 is formed on the anterior inner face of a hood 12 of an outer hosing 11. This guiding member 72 is an inwardly inclining face. The guiding member 72 is formed on the left side (relative to FIG. 25) of the hood 12. That is, it is formed on the same side as a retainer attachment hole 55 of a female housing 50. The guiding member 72 is formed at approximately the same height as a retainer 56 which is inserted into the retainer attachment hole 55.

The guiding member 72 is formed in a tapered shape at the anterior inner face of the hood 12. Consequently, the configuration of the connector is simplified. Moreover, the configuration of the other parts, and their operation and effects, is the same as in the second embodiment, and a description thereof is omitted.

The present invention is not limited to the embodiments described above with the aid of figures. For example, the possibilities described below also lie within the technical range of the present invention. In addition, the present invention may be embodied in various other ways without deviating from the scope thereof.

(1) The second and third embodiments have described a means for moving a retainer into a correct position while male and female connector housings are fitted together. However, the present invention is equally suitable for use in a male connector housing which is not divided into two.

(2) As a specific example of (1) above, one of the connector housings may be provided with a guiding member and a guiding groove, and the other connector housing with a rib. Accordingly, the retainer may be moved into the correct position by the guiding member while it is being fitted with the other connector housing, and the rib may be inserted into the guiding groove to guide the fitting operation.

(3) The above embodiment describes a waterproof connector. However, the present invention is also suitable for other types of connectors.

What is claimed is:

1. An electrical connector comprising:

a terminal retaining body having at least one cavity to receive an electrical terminal therein;

a retainer insertable into the terminal retaining body from a protruding condition to a non-protruding temporary position, the retainer further being movable in the terminal retaining body between the temporary position permitting insertion of the electrical terminal into the cavity and a final position to retain the electrical terminal in the cavity; and a tubular housing to receive the terminal retaining body and retainer therein, the tubular housing including an inner surface with a guiding member along the inner surface to contact and move the retainer from the protruding condition to the non-protruding temporary position as the terminal retaining body with the retainer are inserted into the tubular housing.

2. An electrical connector according to claim 1 wherein said first guiding member comprises a tapered face for engagement with said retainer, said tapered face being directed inwardly of the housing with respect to the direction of insertion.

3. An electrical connector according to claim 2 wherein said first guiding member including a channel in the inner face of said tubular housing, the channel guiding a protruding retainer to said tapered face.

4. An electrical connector according to claim 3, and a mating connector, the mating connector being receivable in said tubular housing, and having a protrusion engageable in said channel.

5. An electrical connector according to claim 4 wherein said mating connector includes a retainer insertable therein from a protruding to a non-protruding condition, and said tubular housing further includes a second guiding member on the inner face thereof, adapted to engage the retainer of said mating connector, and to urge that retainer to a non-protruding condition as the mating connector is received within said tubular housing.

6. An electrical connector according to claim 5 wherein said second guiding member comprises a tapered face.

7. An electrical connector according to claim 6 wherein said first and second guiding members are opposite each other on said tubular housing (11).

8. An electrical connector according to claim 1 wherein the retainer of said terminal retaining body is latchable in said body in a non-protruding condition.

9. An electrical connector according to claim 5 wherein the retainer of said mating connector is latchable in said body in protruding and non-protruding conditions.

10. An electrical connector according to claim 6 wherein the retainer of said mating connector is latchable in said body in protruding and non-protruding conditions.

11. An electrical connector according to claim 7 wherein the retainer of said mating connector is latchable in said body in protruding and non-protruding conditions.

12. An electrical connector according to claim 9 wherein said mating connector is latchable in said tubular housing.

13. An electrical connector according to claim 10 wherein said mating connector is latchable in said tubular housing.

14. An electrical connector according to claim 11 wherein said mating connector is latchable in said tubular housing.

15. An electrical connector assembly comprising:

a first connector including a terminal retaining body having at least one cavity to receive an electrical terminal therein, and a retainer insertable into the terminal retaining body and movable between a protruding condition permitting insertion of the electrical terminal into the cavity and a non-protruding final position to retain the electrical terminal in the cavity; and a second connector having a tubular housing to receive the terminal retaining body and retainer therein, the tubular housing including an inner surface with a guiding member along the inner surface to contact and move the retainer from the protruding condition to the non-protruding final position as the terminal retaining body with the retainer are inserted into the tubular housing.

16. An electrical connector in accordance with claim 1 wherein the retainer is partially inserted into the terminal retaining body in the protruding condition.

17. An electrical connector in accordance with claim 15 wherein the retainer is partially inserted into the terminal retaining body in the protruding condition.

* * * * *